US008511670B2

(12) United States Patent
Maeda

(10) Patent No.: US 8,511,670 B2
(45) Date of Patent: Aug. 20, 2013

(54) SHEET CONVEYING DEVICE, IMAGE READER, AND IMAGE FORMING APPARATUS

(75) Inventor: Hiroshi Maeda, Nagoya (JP)

(73) Assignee: Ricoh Company, Limited, Tokyo (JP)

( * ) Notice: Subject to any disclaimer, the term of this patent is extended or adjusted under 35 U.S.C. 154(b) by 7 days.

(21) Appl. No.: 12/926,991

(22) Filed: Dec. 22, 2010

(65) Prior Publication Data

US 2011/0180984 A1 Jul. 28, 2011

(30) Foreign Application Priority Data

Jan. 22, 2010 (JP) ..... 2010-012480

(51) Int. Cl.
*B65H 7/08* (2006.01)

(52) U.S. Cl.
USPC ..... 271/110; 271/10.02

(58) Field of Classification Search
USPC ..... 271/38, 3.15, 3.17, 10.02, 10.03, 271/110, 111, 258.01
See application file for complete search history.

(56) References Cited

U.S. PATENT DOCUMENTS

| | | | | |
|---|---|---|---|---|
| 5,016,864 | A * | 5/1991 | Nonami | 271/38 |
| 5,915,691 | A * | 6/1999 | Deguchi et al. | 271/265.01 |
| 5,963,754 | A * | 10/1999 | Itoh et al. | 399/21 |
| 6,473,576 | B1 | 10/2002 | Koshimizu | |
| 6,955,351 | B2 * | 10/2005 | Sueoka | 271/265.01 |
| 7,320,462 | B2 * | 1/2008 | Takamatsu | 271/3.14 |
| 7,515,867 | B2 * | 4/2009 | Yano | 399/393 |
| 7,549,622 | B2 * | 6/2009 | Butikofer | 271/3.15 |
| 2007/0025746 | A1 * | 2/2007 | Hayashi et al. | 399/21 |
| 2007/0069454 | A1 | 3/2007 | Ino | |
| 2010/0025912 | A1 * | 2/2010 | Kotaka et al. | 271/3.15 |
| 2010/0061781 | A1 * | 3/2010 | Won | 399/367 |
| 2011/0031684 | A1 * | 2/2011 | Nireki | 271/265.01 |

FOREIGN PATENT DOCUMENTS

| | | | | |
|---|---|---|---|---|
| CN | 1275726 | A | | 6/2000 |
| JP | 59203016 | A | * | 11/1984 |
| JP | 01203138 | A | * | 8/1989 |
| JP | 2003081485 | A | * | 3/2003 |
| JP | 2005060058 | A | * | 3/2005 |
| JP | 2006227464 | A | * | 8/2006 |
| JP | 2007-091402 | A | | 4/2007 |
| JP | 2009199382 | A | * | 9/2009 |

OTHER PUBLICATIONS

Ex Parte Shirley; Appeal 2009-2352 p. 22.*
Chinese Office Action for corresponding Chinese Application 201110026326.8 dated Apr. 3, 2013 and English translation of Office Action.

* cited by examiner

*Primary Examiner* — Michael McCullough
*Assistant Examiner* — Howard Sanders
(74) *Attorney, Agent, or Firm* — Harness, Dickey & Pierce P.L.C.

(57) ABSTRACT

A sheet conveying device includes: an openable-and-closable cover including a handle and a detecting member that detects presence of a sheet, wherein the detecting member is caused to rotate in association with the handle in a process of closing the cover.

11 Claims, 7 Drawing Sheets

SHEET CONVEYING DEVICE, IMAGE READER, AND IMAGE FORMING APPARATUS

CROSS-REFERENCE TO RELATED APPLICATIONS

The present application claims priority to and incorporates by reference the entire contents of Japanese Patent Application No. 2010-012480 filed in Japan on Jan. 22, 2010.

BACKGROUND OF THE INVENTION

1. Field of the Invention

The present invention relates to a sheet conveying device used in a document feeder of an image reader or an image forming apparatus, or used in a sheet post-processing unit (finisher) of an image forming apparatus, to an image reader having the sheet conveying device, and to an image forming apparatus, such as a copying machine, a printer, a facsimile, or a multifunctional product (MFP) including these functions, having the sheet conveying device or the image reader.

2. Description of the Related Art

In a sheet conveying device used in a document feeder and the like, as a technique using a feeler as a detecting member for detecting a sheet, the conventional technology disclosed in Japanese Patent Application Laid-open No. 2007-91402 is known, for example.

FIG. 8 is a schematic of an original setting unit included in an example of such a document feeder. In the configuration illustrated in FIG. 8, a cover 50, also functioning as a guide member for feeding an original, is closed in the direction of an arrow A while an original 1 is present in the original setting unit. A feeler 51 is a detecting member for detecting the presence of an original, and a sensor not illustrated is turned on or off in association with the operation of the feeler 51. A holder holding a rotation fulcrum 51*a* of the feeler 51 is disposed in the cover 50, and moves in association with an opening or a closing operation of the cover 50.

Because such a sheet detecting technique is generally well known, a detailed explanation thereof is omitted herein.

The conventional example illustrated in FIG. 8 has the following disadvantages.

When the original 1 is to be set, the cover 50 is usually closed. Even when the operation stops due to an erroneous feeding of the original 1 being conveyed, the cover 50 is once opened to remove the original 1, and the cover 50 is closed before setting the original 1 again. Therefore, such an operation will not result in the configuration illustrated in FIG. 8. However, if a normal operation is not performed, in other words, the cover 50 is closed after opening the cover 50 without removing the original 1, the original 1 might get damaged when the feeler 51 is brought in contact with the original 1, depending on an angle θ1 formed between the feeler 51 and the original 1.

In other words, when the angle θ1 is larger than 45 degrees, the possibility of the original 1 being damaged will increase; and when the angle θ1 is smaller, the damage on the original 1 is reduced.

Moreover, although the angle θ1 can be reduced by disposing the fulcrum 51*a* of the feeler 51 at a more upstream position as illustrated in FIG. 9, the fulcrum 51*a* cannot be always disposed at a more upstream position depending on the arrangement of the other components. Furthermore, the size of the device itself is increased, disadvantageously.

The present invention is made in consideration of such circumstances, and an object of the present invention is to provide a sheet conveying device that can remove such inconvenience of the conventional technique, and that can prevent a detecting member that detects the presence of a sheet from damaging the sheet. Another object of the present invention is to provide an image reader having such a sheet conveying device, and to provide an image forming apparatus having such a sheet conveying device or such an image reader.

SUMMARY OF THE INVENTION

It is an object of the present invention to at least partially solve the problems in the conventional technology.

According to an aspect of the present invention, there is provided a sheet conveying device comprising: an openable-and-closable cover including a handle and a detecting member that detects presence of a sheet, wherein the detecting member is caused to rotate in association with the handle in a process of closing the cover.

According to another aspect of the present invention, there is provided an image reader comprising the sheet conveying device mentioned above.

According to still another aspect of the present invention, there is provided an image forming apparatus comprising the sheet conveying device mentioned above.

According to still another aspect of the present invention, there is provided an image forming apparatus comprising the image reader mentioned above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below in detail with reference to drawings.

Figure 1:
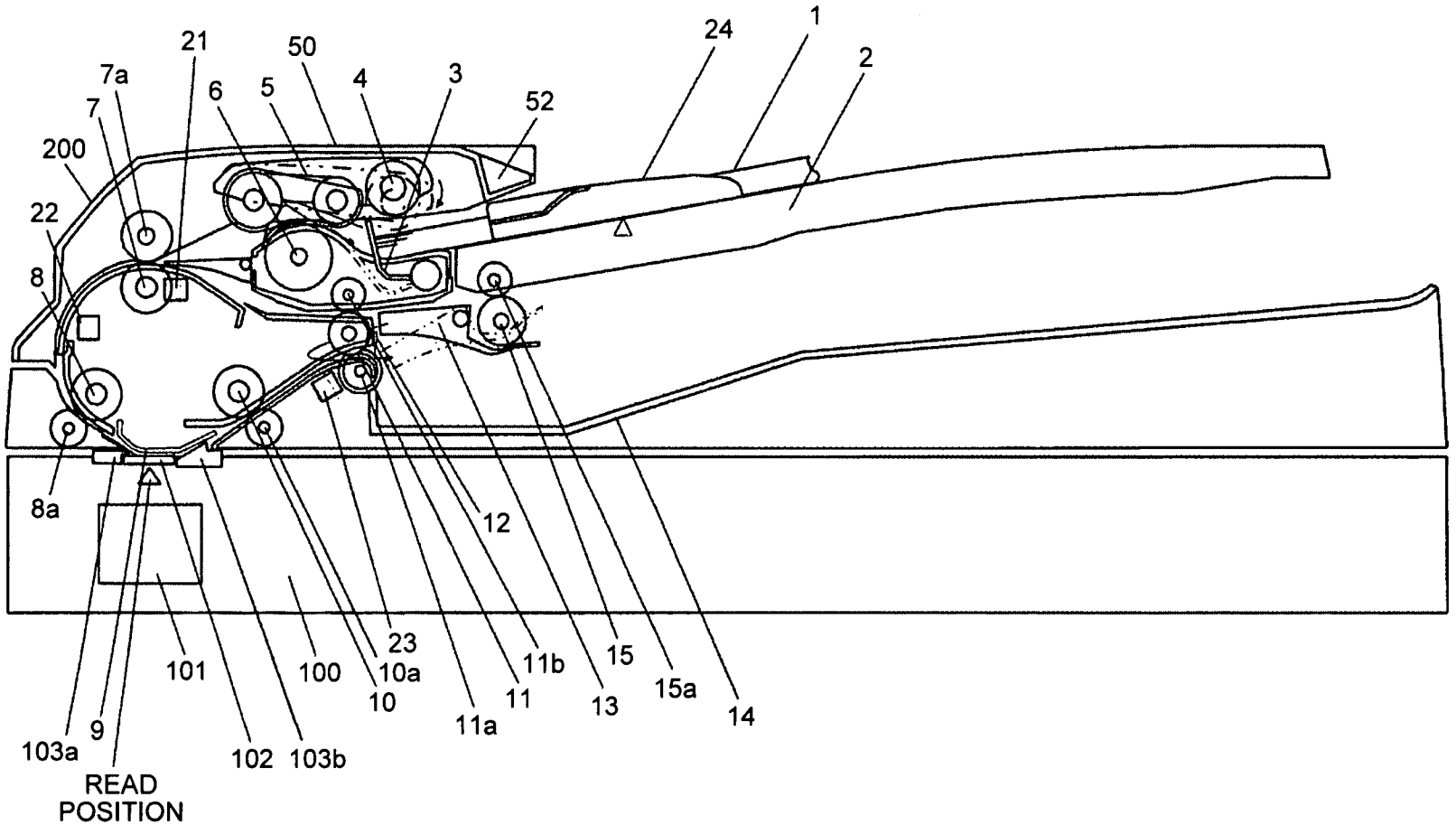
FIG. 1 is a schematic of an exemplary structure of an image reader including a sheet conveying device according to an embodiment of the present invention as a document feeder.

FIG. 1 is a schematic of an exemplary structure of an image reader including a sheet conveying device according to an embodiment of the present invention as a document feeder. The image reader illustrated in FIG. 1 is used as a so-called image scanner, or as an image reader mounted on an image forming apparatus (a copying machine, a printer, a facsimile, or a multi-functional product (MFP) having these functions) such as the one illustrated in FIG. 7. An exemplary structure of the image forming apparatus will be described later.

The exemplary structure illustrated in FIG. 1 is a structure of a document feeder (generally referred to as an automatic document feeder (ADF)), which is an example of the sheet conveying device. However, the sheet conveying device may be used in a sheet post-processing unit (such as a finisher) included in a copying machine, a printer, a facsimile, an MFP including these functions, a printing machine, or the like. Because a driving technique and the like are not distinctive characteristics of the present invention and are well known, detailed explanations thereof are omitted herein.

In FIG. 1, the reference numeral 1 denotes an original (sheet), the reference numeral 2 denotes an original table, the reference numeral 3 denotes a stopping claw, the reference numeral 4 denotes a calling roller, the reference numeral 5 denotes a paper feeding member, the reference numeral 6 denotes a separating member, the reference numeral 7 denotes an abutting roller, the reference numeral 7*a* denotes an abutting driven roller, the reference numeral 8 denotes an entrance roller, the reference numeral 8*a* denotes an entrance driven roller, the reference numeral 9 denotes a scanning guide member, the reference numeral 10 denotes an exit roller, the reference numeral 10*a* denotes an exit driven roller, the reference numeral 11 denotes a discharging roller, the reference numeral 11*a* denotes a lower discharging driven roller, the reference numeral 11*b* denotes an upper discharging driven roller, the reference numeral 12 denotes a neutralizing brush, the reference numeral 13 denotes a switching claw, the reference numeral 14 denotes a discharge tray, the reference numeral 15 denotes a reverse roller, the reference numeral 15*a* denotes a reverse driven roller, the reference numeral 21 denotes an abutting sensor, the reference numeral 22 denotes a registration sensor, the reference numeral 23 denotes a discharging sensor, the reference numeral 24 denotes a side fence, the reference numeral 50 denotes a cover of a paper feeding unit, the reference numeral 100 denotes an image reader (apparatus main body), the reference numeral 101 denotes a scanning unit, the reference numeral 102 denotes an exposure glass, the reference numeral 103*a* denotes a main body side guide, the reference numeral 103*b* denotes a main body side guide, and the reference numeral 200 denotes a document feeder (sheet conveying device).

As illustrated in FIG. 1, the document feeder 200 is mounted on top of the main body of the image reader 100. A document feeder/separator for sequentially feeding the original 1 is stacked on the original platen (hereinafter, referred to as an original table) 2 from the sheet on the top. The document feeder includes the stopping claw 3 for holding the leading edge of the original placed on the original table 2, the calling roller 4 that is permitted to rotate up to a position being in contact with the feeding side of the top surface of the original table 2, the paper feeding member 5 for taking in the original 1 called by the calling roller 4 by being rotated in a feeding direction, and the separating member 6 that rotates in a direction opposite to the feeding direction to separate one sheet at the top of the fed original 1. The calling roller 4 is driven by a solenoid not illustrated, and the paper feeding member 5, the separating member 6, and the like are driven by a motor not illustrated.

The original 1 is fed one sheet at a time by the paper feeding member 5 and the separating member 6, and is conveyed by a pair of abutting rollers (the abutting roller 7 and the abutting driven roller 7*a*). A conveying unit, for conveying the original 1 thus fed to a read position on the exposure glass 102, includes a pair of entrance rollers (the entrance roller 8 and the entrance driven roller 8*a*), a pair of exit rollers (the exit roller 10 and the exit driven roller 10*a*), and the like. These rollers are driven by a motor not illustrated.

The abutting sensor 21, the registration sensor 22, and the discharging sensor 23 are arranged along the conveying path for the original 1 in order to detect the position at which the original 1 is being conveyed.

The scanning unit 101 for reading an image surface of the original 1 includes an optical system (not illustrated) composed of an exposure lamp, a first mirror, an imaging lens, and the like, and is enclosed in a main body of the image reader 100 located under the exposure glass 102. To scan the image, the exposure lamp and the first mirror are moved in the lateral direction in FIG. 1 under the exposure glass 102, or stopped under the read position, for example, so that the image surface is irradiated with light output from the exposure lamp. The reflected light is focused onto a photosensitive element not illustrated via the first mirror and the optical system; and toner or the like is attached to an electrostatic latent image formed on the photosensitive element so as to transfer the image onto a recording sheet. Alternatively, the reflected light could also be focused onto an image sensor including charge-coupled devices (CCDs) via the first mirror and the optical system, so that the optical signal is converted into an electrical signal in the image sensor; and the image is transferred onto a recording sheet using various images forming means.

The ADF 200 according to the embodiment is connected to the main body of the image reader 100 by using a connecting member such as a hinge not illustrated; and is structured in an openable and closable manner. The cover 50 of the paper feeding unit in the document feeder 200 is also structured to be openable and closable by releasing a locking mechanism included in a handle in the manner to be described later.

EXAMPLE

First Example

Specific examples of the document feeder (sheet conveying device) according to the present invention are described below with reference to FIGS. 2 to 6.

Figure 2:
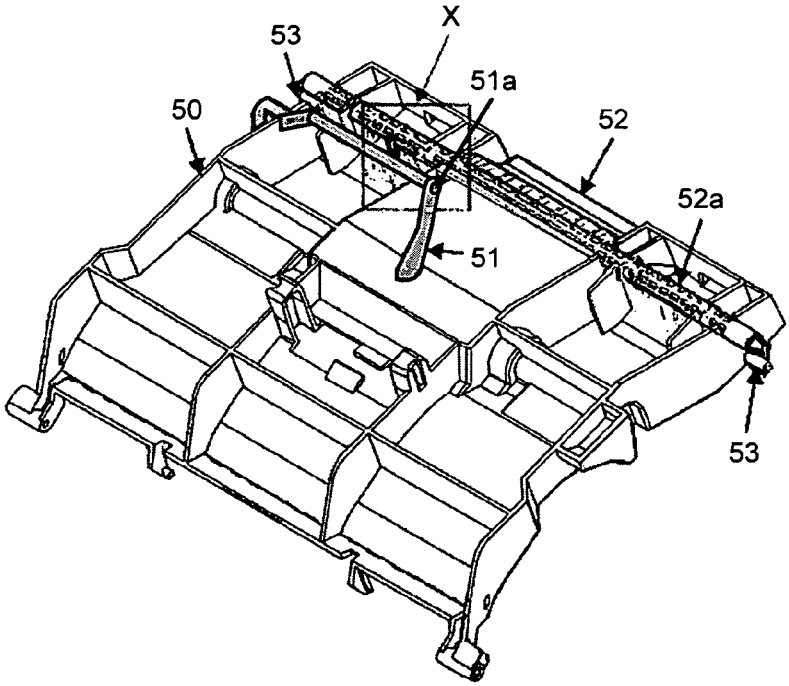
FIG. 2 is a perspective view of a cover of a paper feeding unit, a handle on the cover, and a feeler that is an original detecting member included in a sheet conveying device (document feeder) as an example according to the embodiment of the present invention.

FIG. 2 is a perspective view of the cover 50 of the paper feeding unit functioning as a guide member for the original being fed, a handle 52 on the cover, and a feeler 51 as an original detecting member included in the document feeder, which is one type of the sheet conveying device according to the embodiment of the present invention. In FIG. 2, a covering member covering the top surface is removed.

Figure 3:
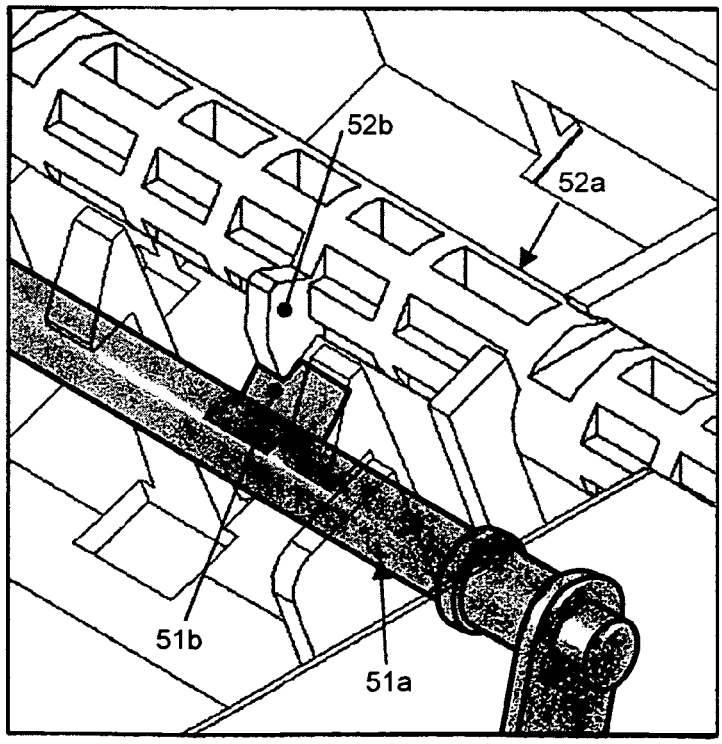
FIG. 3 is an enlarged perspective view of the portion X illustrated in FIG. 2.
Figure 4:
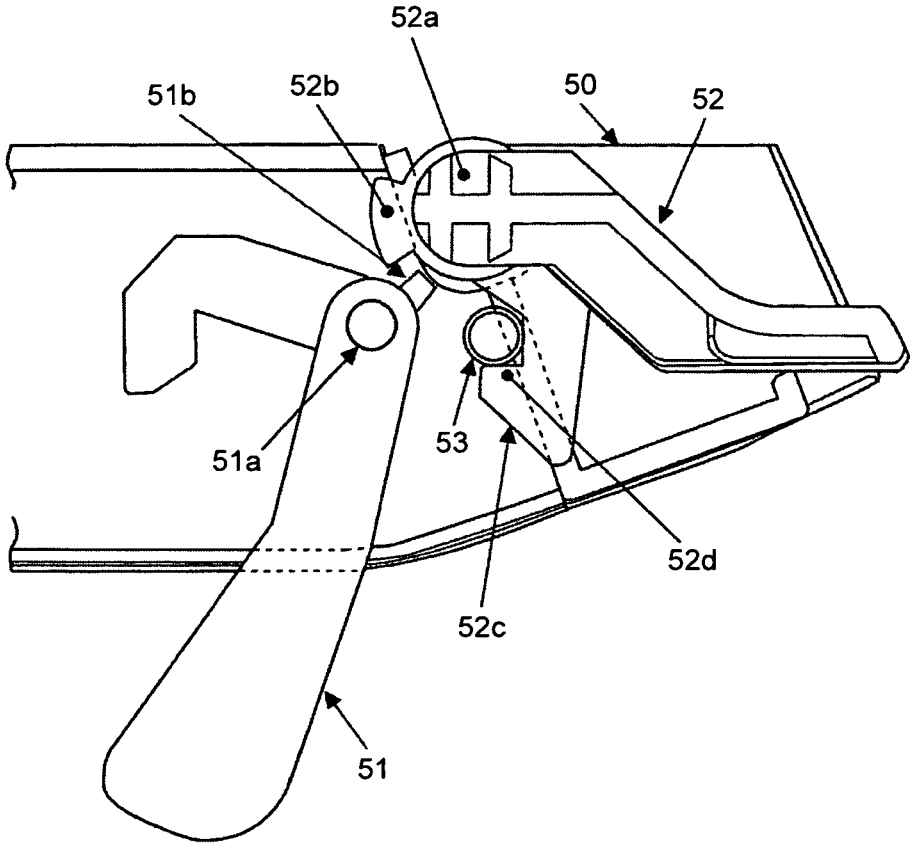
FIG. 4 is a front view of the handle on the cover and the feeler illustrated in FIG. 2.

FIG. 3 is an enlarged view of the section X illustrated in FIG. 2. FIG. 4 is a front view of the handle 52 on the cover and the feeler 51 illustrated in FIG. 2.

The cover 50 can be rotated about a fulcrum not illustrated; and the feeler 51 and the handle 52 are disposed on the cover 50 and are moved in association with the rotation of the cover 50. The feeler 51 can be rotated about the fulcrum 51*a*. The handle 52 can be rotated about a fulcrum 52*a*. The reference numeral 53 denotes a shaft for preventing the position of the cover 50 from being shifted. The shaft 53 is included in a structure not illustrated, and is fixed without moving in association with the movement of the cover 50. The cover 50 is kept immovable (kept unable to be opened) by turning a lock

52*d* included in a guide 52*c* of the handle 52 on, so that the lock 52*d* will hold the shaft 53 while the cover 50 is set.

Figure 5A:
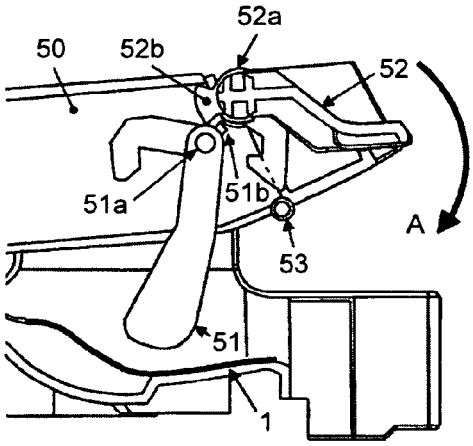
FIGS. 5A to 5D are schematics of an operation of the sheet conveying device in the example according to the embodiment of the present invention.

FIGS. 5A to 5D are schematics of an operation of the sheet conveying device in the example according to the embodiment of the present invention. FIG. 5A depicts the cover 50 being closed in the direction of the arrow A. Under the state illustrated in FIG. 5A, the feeler 51 is not in contact with the original 1.

Figure 5B:
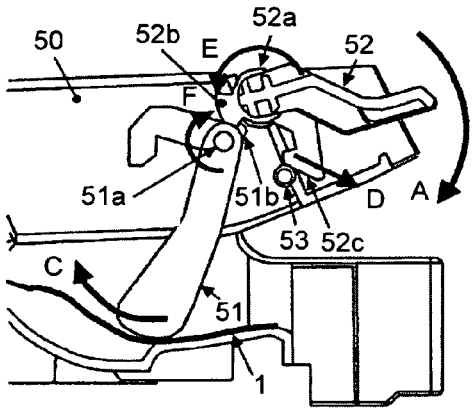
Figure 5C:
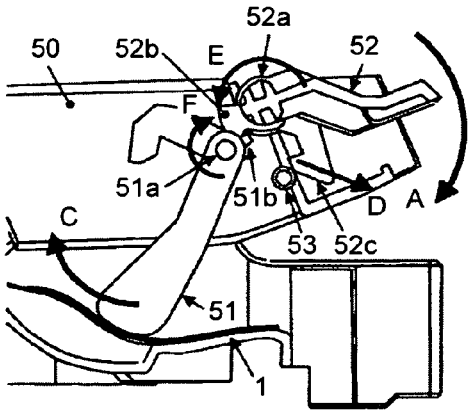
Figure 5D:
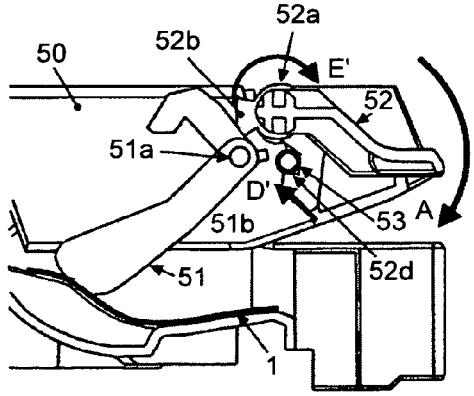

FIGS. 5B to 5D depict the process of the cover 50 that is being gradually closed. In FIG. 5B, the guide 52*c* on the handle 52 is brought into contact with the shaft 53; and the cover 50 is closed while the guide 52*c* is moving in the direction of the arrow D. At this time, the handle 52 is rotated about the fulcrum 52*a* in the direction of the arrow E. As the handle 52 is rotated in the direction of the arrow E, a protrusion 52*b* on the handle 52 is brought into contact with a protrusion 51*b* on the feeler 51, causing the protrusion 52*b* on the handle 52 to press the protrusion 51*b* on the feeler 51. In response, the feeler 51 is caused to rotate about the fulcrum 51*a* in the direction of the arrow F. As the feeler 51 is rotated in the direction of the arrow F, the part of the feeler 51 being in contact with the original 1 is rotated in the direction of the arrow C so as to be escaped from the original 1. FIG. 5C depicts the cover 50 being closed further from FIG. 5B. The guide 52*c* on the handle 52 is moved in the direction of the arrow D. The handle 52 is rotated in the direction of the arrow E; and the feeler 51 is rotated in the direction of the arrow F. The part of the feeler 51 being in contact with the original is further rotated in the direction of the arrow C.

As the cover 50 is closed further, the guide 52*c* on the handle 52 moves in the direction of the arrow D; the guide 52*c* on the handle 52 passes over the shaft 53; the guide 52*c* on the handle 51 is released; the fulcrum 52*a* is rotated by the load of a spring not illustrated in the direction of the arrow E'; and the guide 52*c* recovers in the direction of the arrow D'. This state is illustrated in FIG. 5D.

As the handle 52 is rotated in the direction of the arrow E', the protrusion 52*b* on the handle 52 and the protrusion 51*b* on the feeler 51 are separated to release the feeler 51. If the original 1 is present under the feeler 51, the feeler 51 is kept not moving and is kept on top of the original 1. This is a state in which the original 1 is being detected.

The original 1 is detected by a detecting member, not illustrated and included in the feeler 51, by turning on and off a sensor not illustrated. Because such a mechanism for turning on and off the sensor is a widely known technology, and because the mechanism for turning on and off the sensor is not within the scope of claims of the present invention, a detailed explanation thereof is omitted herein.

Figure 6:
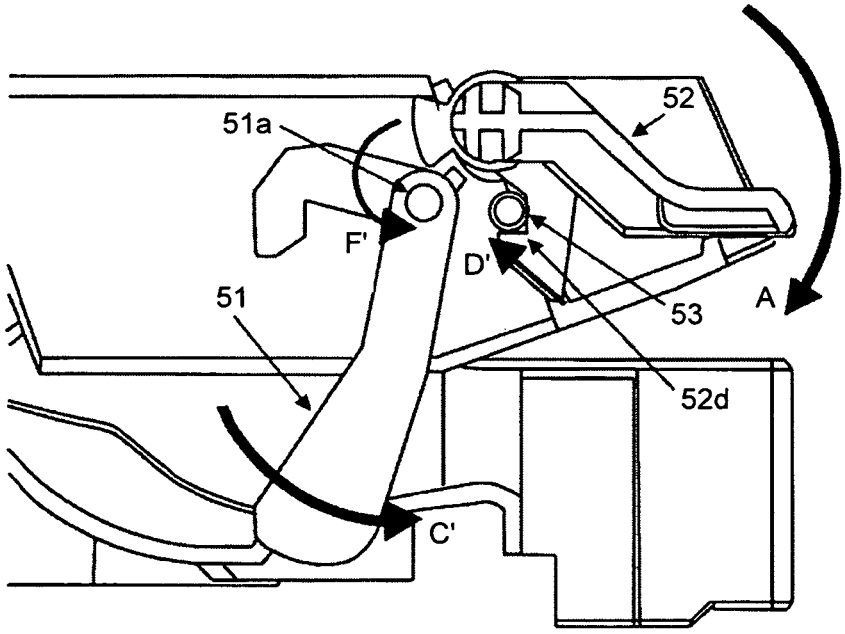
FIG. 6 is a front view of the feeler having no original underneath.

As illustrated in FIG. 6, when there is no original 1 under the feeler 51, the fulcrum 51*a* of the feeler rotates in the direction of the arrow F'; and the part of the feeler 51 brought into contact with the original 1 is rotated in the direction of the arrow C'. In this state, the feeler 51 detects no original 1.

In the example illustrated in FIGS. 2 to 5D, the feeler 51 that is a detecting member is explained to be rotated in association with the handle 52 on the cover 50. However, as long as the feeler 51 is rotated in the process of closing the cover 50, the feeler 51 does not necessarily have to be moved in association with the handle 51. For example, with a protrusion being provided somewhere on the separator, the feeler 51 may be configured to be rotated by a part of the feeler 51 that is brought into contact with the protrusion during the process of closing the cover 50.

As described above, in the sheet conveying device according to the embodiment of the present invention, in the process of closing the cover 50, the feeler (detecting member) 51 is caused to rotate in association with the handle 52, so that the sheet (original) 1 can be protected against being damaged by the feeler (detecting member) 51.

Furthermore, in the sheet conveying device according to the embodiment of the present invention, the handle 52 on the cover 50, structured in an openable and closable manner, includes a locking mechanism (the lock 52*d* included in the guide 52*c* on the handle 52) for locking the cover 50 while the cover 50 is closed. Therefore, because the feeler (detecting member) 51 is caused to rotate in association with the locking mechanism included in the handle 52 in the process of closing the cover 50, the sheet (original) 1 can be protected against being damaged by the feeler (detecting member) 51 when the cover 50 is closed.

Furthermore, in the sheet conveying device according to the embodiment of the present invention, because the feeler (detecting member) 51 is escaped downstream in the sheet conveying direction in the process of closing the cover 50 (as illustrated in FIGS. 5B to 5D), the angle at which the feeler (detecting member) 51 abuts the sheet (original) 1 reduces. Therefore, the sheet (original) 1 can be prevented from being damaged.

Second Example

Figure 7:
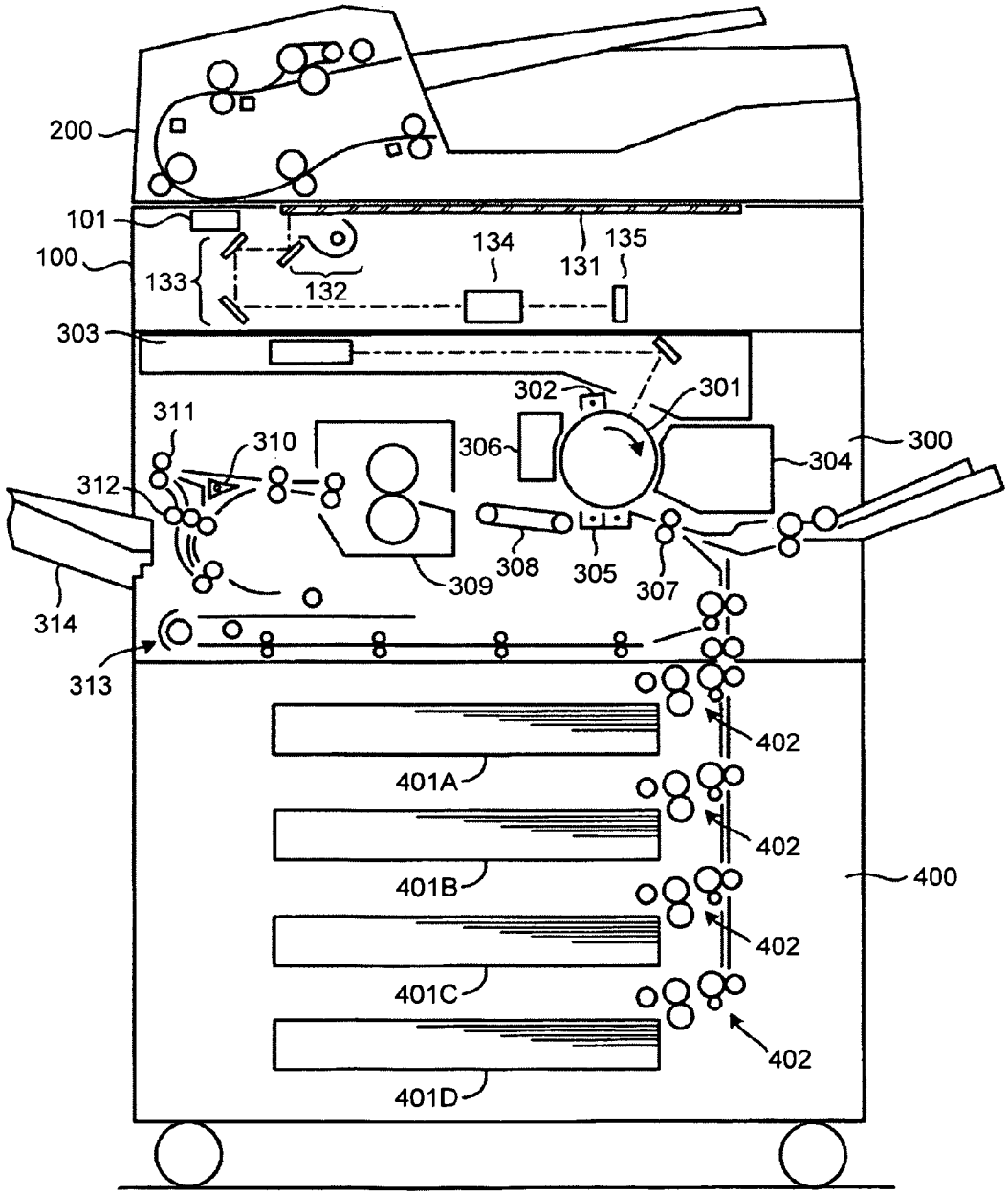
FIG. 7 is a schematic of an image forming apparatus including an image reader 100 having the sheet conveying device (document feeder) 200 as another example according to the embodiment of the present invention.
Figure 8:
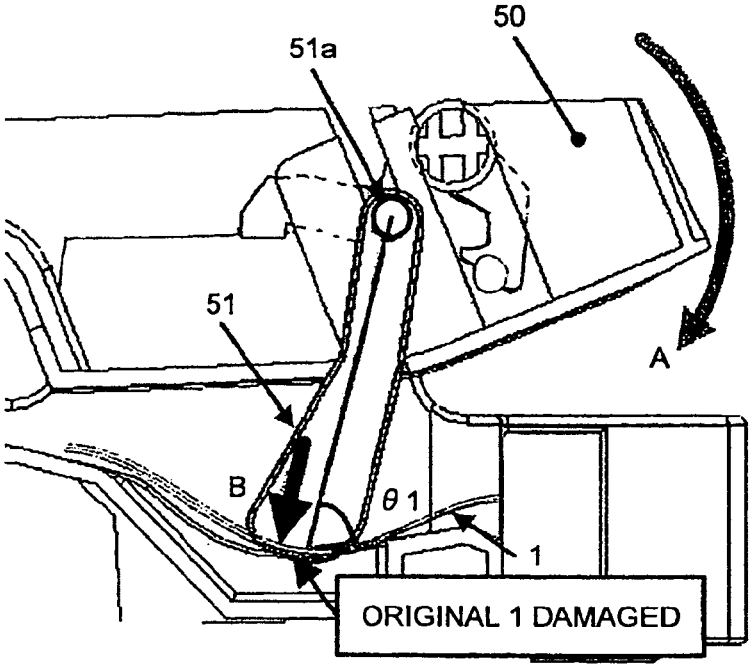
FIG.8 CONVENTIONAL ART
FIG. 8 is a front view of an original setting unit included in a conventional document feeder.
Figure 9:
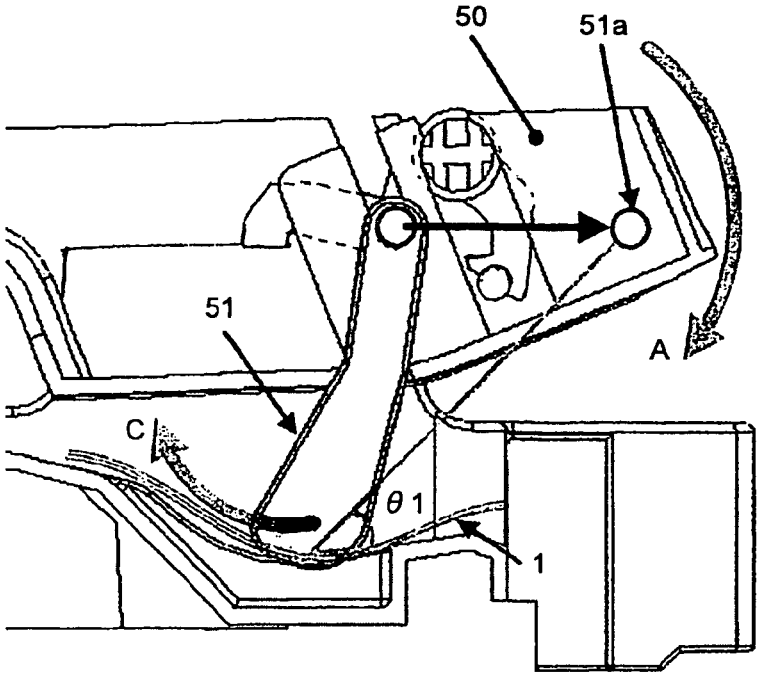
FIG.9 CONVENTIONAL ART
FIG. 9 is a schematic for explaining the disadvantages of the conventional document feeder.

FIG. 7 is a schematic of an image forming apparatus including the image reader 100 having the sheet conveying device (document feeder) 200 as another example according to the embodiment of the present invention.

This image forming apparatus is an example of a digital MFP having the functions of a copying machine, a printer, and a facsimile. The image reader 100 and the document feeder (ADF) 200 are mounted on an image forming unit (printer unit). A paper feeding unit 400 is disposed under this image forming unit 300.

The structures of the image reader 100 and the document feeder 200 are the same as those illustrated in FIG. 1. The image on the original fed by the document feeder 200 is read at the position of the scanning unit 101. At this time, a carriage 132, on which the exposure lamp and the first mirror included in image reader 100 are mounted, is moved to the position corresponding to the scanning unit 101; and the reflected image of the original illuminated with the exposure lamp on the carriage 132 is formed on an image capturing unit (an image sensor including CCDs) 135 via the first mirror mounted on the carriage 132, a movable mirror 133, and an imaging lens 134. The image capturing unit 135 then converts the optical signal into an electrical signal, and transmits the electrical signal to the image forming unit 300. If the original is placed manually onto an exposure glass 131, the carriage 132, on which the exposure lamp and the first mirror are mounted, is moved along the surface of the original placed on the exposure glass 131; and the image on the original is formed on the image capturing unit 135 via the movable mirror 133 and the imaging lens 134 moving together with the carriage 132. The image capturing unit 135 converts the optical signal into an electrical signal, and transmits the electrical signal to the image forming unit 300.

The image forming unit 300 in the example illustrated in FIG. 7 is a laser printer using the electrophotography process. A charging unit 302, an optical writing device 303, a developing unit 304, a transfer unit 305, a cleaning unit 306, and the like are arranged around a drum-shaped photosensitive element 301 that is an image carrier. A pair of registration rollers 307 is arranged upstream of the transfer unit 305 in the sheet conveying direction. A carriage belt 308 and a fixing unit 309 are arranged downstream of the transfer unit 305 in the sheet conveying direction. A conveying direction switching claw 310, a discharging roller 311, a duplex printing carriage roller 312, a duplex printing reversing and conveying unit 313, and a discharge tray 314 are arranged downstream of the fixing unit 309 in the sheet conveying direction.

The paper feeding unit 400 disposed under the image forming unit 300 includes multiple stages of paper cassettes 401A to 401D, each storing therein sheets (recording sheets) of different sizes. Each of the paper cassettes 401A to 401D is provided with a feeding device 402 that feeds recording sheets one by one.

In the image forming apparatus having such a structure, when an original is set to the document feeder 200 and a start key arranged on an operating section, not illustrated, of the image forming apparatus is pressed, the original starts to be fed; and the image on the original is read at the position of the scanning unit 101 included in the image reader 100. The image capturing unit 135 then converts the optical signal into an electrical signal, and transmits the electrical signal to the image forming unit 300. In the image forming unit 300, the photosensitive element 301 is caused to rotate at the operational timing of reading of the image on the original; and the surface of the photosensitive element is charged by the charging unit 302. The optical writing device 303 is a laser scanning optical writing device that uses an optical deflector to deflect a laser beam output from a laser light source so as to scan the surface of the photosensitive element via a scanning imaging optical system. The laser light source included in the optical writing device 303 is controlled by an image signal received from the image reader 100; the photosensitive element 301 is exposed to the laser beam whose intensity is modulated according to the original image; and an electrostatic latent image is formed on the photosensitive element 301. The electrostatic latent image formed on the photosensitive element is developed and visualized using toner in the developing unit 304.

In synchronization with this image forming operation, each feeding device 402 feeds a recording sheet from selected one of the multiple stages of the paper cassettes 401A to 401D included in the paper feeding unit 400; and the recording sheet is conveyed into the pair of registration rollers 307 via the carriage roller. The recording sheet is then sent out by the pair of registration rollers 307 at the operational timing at which the toner image formed on the photosensitive element arrives at the position corresponding to the transfer unit 305; and the transfer unit 305 transfers the toner image onto the recording sheet. The recording sheet on which the toner image is transferred is conveyed to the fixing unit 309 on the carriage belt 308; and the fixing unit 309 fixes the toner image onto the recording sheet. For single-side printing, the recording sheet, after the toner image fixed, is discharged onto the discharge tray 314 by the discharging roller 311. When duplex printing is to be performed, the recording sheet is conveyed to the duplex printing reversing and conveying unit 313 by the duplex printing carriage roller 312. The side of the recording paper is reversed by the duplex printing reversing and conveying unit 313, and the recording paper is sent into the pair of registration rollers 307. After an image is formed on the rear side of the recording sheet through the image scanning operation and the image forming operation in the same manner mentioned above, the recording sheet is discharged out onto the discharge tray 314.

In the image forming apparatus according to the embodiment of the present invention having such a structure and performing such operations, the document feeder 200 includes the sheet conveying device having the structure explained in the first example, so that originals can be protected against being damaged even if an erroneous feeding of the originals occurs, for example.

In the second example above, the image forming unit 300 is explained as a laser printer using the electrophotography process. Alternatively, the image forming unit 300 may be a printer such as a stencil printing machine.

Furthermore, the sheet conveying device according to the embodiment of the present invention is explained as a device that is used in the document feeder 200. However, the structure of the sheet conveying device according to the embodiment of the present invention illustrated in FIGS. 2 to 6 may be applied to a post-processing unit such as a finisher arranged together with an image forming apparatus and performing a post-process to sheets (recording sheets) after image formation.

In the sheet conveying device according to the present invention, because the detecting member is rotated in association with the handle in the process of closing the cover, sheets can be protected against being damaged by the detecting member.

Furthermore, in the sheet conveying device according to the present invention, because the handle on the open-and-close cover has a locking mechanism used while the cover is closed, and because the detecting member is rotated in association with the locking mechanism of the handle in the process of closing the cover, sheets can be protected against being damaged by the detecting member when the cover is closed.

Furthermore, in the sheet conveying device according to the present invention, because the detecting member is escaped downstream in the sheet conveying direction to be brought into contact with sheets at a wider angle (not abrupt angle) in the process of closing the cover, the sheets can be protected against being damaged.

Because the image reader according to the present invention includes the sheet conveying device having the structure and the advantages described above, originals can be protected against being damaged.

Furthermore, because the image forming apparatus according to the present invention includes the sheet conveying device or the image reader having the structure and the advantages described above, originals or sheets after formed with images thereon can be protected against being damaged.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device, comprising:

an openable-and-closable cover including a handle, which is separate from the cover, and a detecting member that detects presence of a sheet, wherein the detecting member is caused to rotate about a first fulcrum in association with the handle rotating about a second fulcrum in a process of closing the cover, a lower part of the detection member is in contact with the sheet during the rotation of the detection member, the handle includes a guide which is brought into contact with a shaft, and in the process of closing the cover, the guide on the handle passes over the shaft, the handle rotates about the first fulcrum in a first direction, and the detecting member rotates about the second fulcrum in a second direction, the first and second directions being opposite directions.

2. The sheet conveying device according to claim 1, wherein the handle on the openable-and-closable cover has a locking mechanism turned on when the cover is closed, and the detecting member is caused to rotate in association with the locking mechanism of the handle in the process of closing the cover.

3. The sheet conveying device according to claim 1, wherein the detecting member is escaped downstream in a sheet conveying direction in the process of closing the cover.

4. An image reader comprising the sheet conveying device according to claim 1.

5. An image forming apparatus comprising the image reader according to claim 4.

6. An image forming apparatus comprising the sheet conveying device according to claim 1.

7. The sheet conveying device according to claim 1, wherein the guide is provided over the shaft to prevent a position of the cover from being shifted.

8. The sheet conveying device according to claim 1, wherein as the handle is rotated, a protrusion on the handle is brought into contact with a protrusion on the detecting member, causing the protrusion on the handle to press against the protrusion on the detecting member.

9. The sheet conveying device according to claim 8, wherein a direction of rotation of the handle is in an opposite direction of rotation of the detecting member.

10. The sheet conveying device according to claim 8, wherein as the handle is rotated in a closing direction, the protrusion on the handle and the protrusion on the detecting member is separated to release the detecting member.

11. The sheet conveying device according to claim 1, further comprising a guide on the handle, wherein as the cover is closing, the guide on the handle moves in a direction toward a shaft to pass over thereto for locking the cover.

* * * * *